United States Patent [19]

Mouser

[11] Patent Number: 4,546,973

[45] Date of Patent: Oct. 15, 1985

[54] BASKETBALL APPARATUS

[75] Inventor: Donald D. Mouser, Plainview, Tex.

[73] Assignee: Horizon Sports, Inc., Lockney, Tex.

[21] Appl. No.: 539,009

[22] Filed: Oct. 3, 1983

[51] Int. Cl.[4] ..... A63B 63/08; A63B 71/04

[52] U.S. Cl. ..... 273/1.5 R; 273/411; 272/3; 248/225.2; 248/231.1

[58] Field of Search ..... 273/1.5, 411; 248/205.1, 231.1, 255.2; 272/3

[56] References Cited

U.S. PATENT DOCUMENTS

| | | | |
|---|---|---|---|
| Re. 20,898 | 10/1938 | Schabenger | 273/1.5 R |
| 855,453 | 6/1907 | Foster | 248/225.2 |
| 2,049,593 | 8/1936 | Schabinger | 273/1.5 R |
| 2,219,528 | 10/1940 | Osness | 273/1.5 R |
| 2,363,634 | 11/1944 | Albach et al. | 273/1.5 R |
| 2,473,908 | 6/1949 | Rubin | 273/1.5 R |
| 2,512,417 | 6/1950 | Cook | 273/1.5 R |
| 2,517,463 | 8/1950 | Cokk | 273/1.5 R |
| 2,534,067 | 12/1950 | Rubin | 273/1.5 R |
| 2,831,689 | 4/1958 | Marsh | 273/1.5 R |
| 2,881,003 | 4/1959 | Drew | 273/1.5 R |
| 2,916,288 | 12/1959 | Chervenka | 273/1.5 R |
| 2,986,282 | 5/1961 | Brink | 248/225.2 X |
| 3,233,853 | 2/1966 | Majewski | 248/231.1 X |
| 3,233,898 | 2/1966 | Sheets et al. | 273/1.5 R |
| 3,532,317 | 10/1970 | Adler | 248/225.2 |
| 3,586,324 | 6/1971 | Bearson | 273/1.5 R |
| 3,872,623 | 3/1975 | Spaulding, Jr. | 273/411 X |
| 4,377,283 | 3/1983 | Mahoney | 273/1.5 R |
| 4,387,898 | 6/1983 | Mangum | 273/411 |
| 4,395,040 | 7/1983 | White | 273/1.5 R |

FOREIGN PATENT DOCUMENTS

| | | | |
|---|---|---|---|
| 681631 | 10/1966 | Belgium | 273/1.5 R |
| 1313021 | 11/1962 | France | 273/1.5 R |

*Primary Examiner*—Paul E. Shapiro

*Attorney, Agent, or Firm*—Litman, Day and McMahon

[57] ABSTRACT

A basketball apparatus including a support structure for mounting a goal in a racquetball/handball court. The support structure includes a frame assembly with a wall subframe for engaging a wall of the court and an extension subframe pivotally connected to the wall subframe and having the goal mounted thereon. The extension subframe and the goal are movable between lowered, play positions and raised, storage position by a hoist mechanism.

18 Claims, 11 Drawing Figures

Fig. 1.
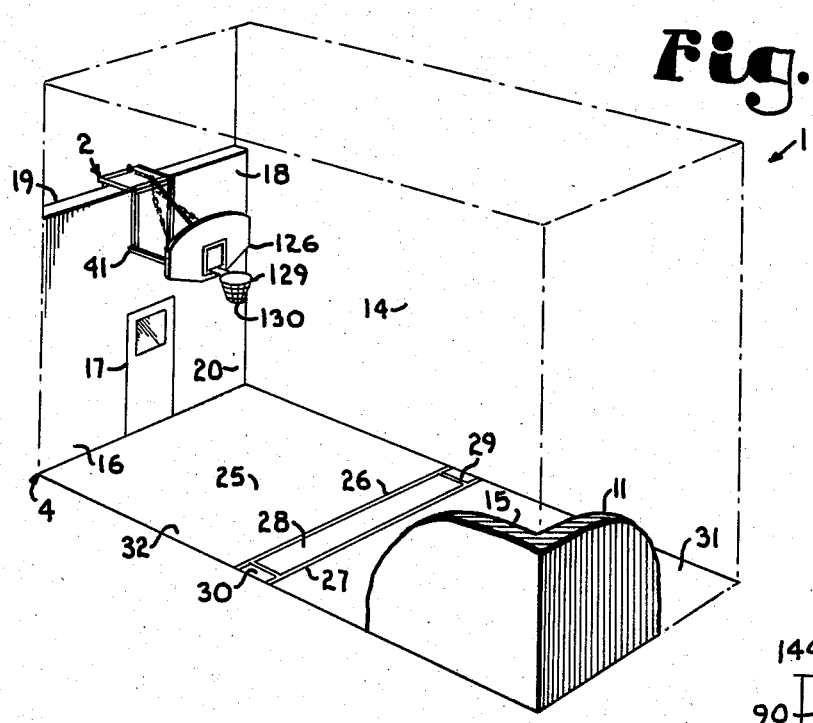
Fig. 6.
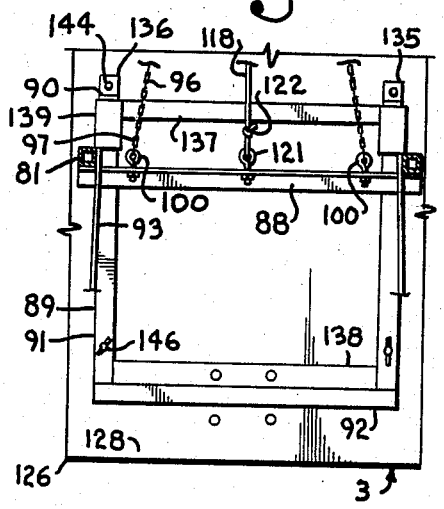
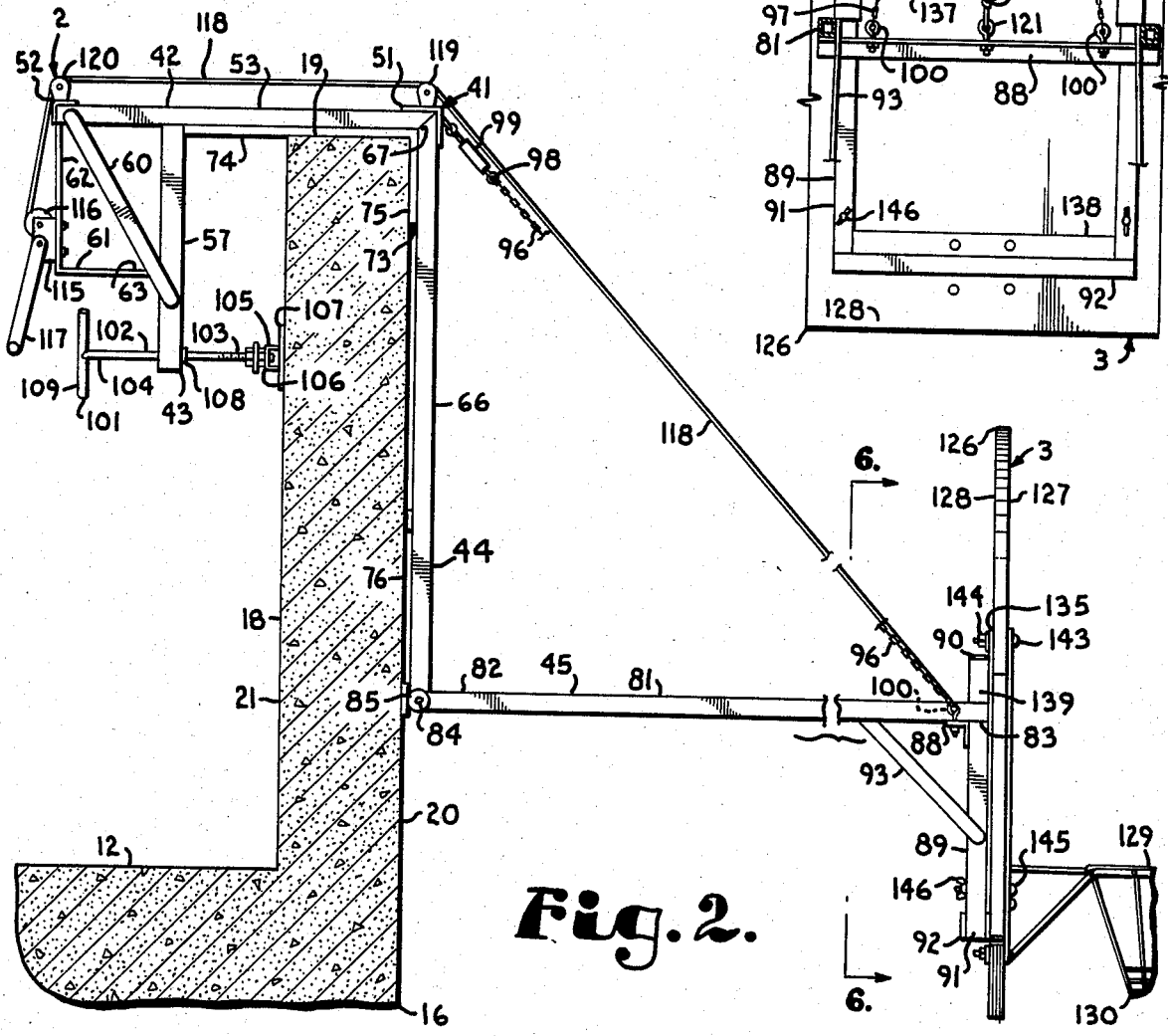
Fig. 2.

BASKETBALL APPARATUS

BACKGROUND OF THE INVENTION

1. Field of the Invention

The present invention relates to sports equipment in general and in particular to a device for adapting a racquetball court for playing a modified form of basketball.

2. Description of the Prior Art

In basketball games, an object is to pass a ball through a horizontal, circular hoop mounted on a vertical, planar backboard to score points. A variety of devices have heretofore been proposed for supporting basketball goals in different areas where basketball games may be played. Full size basketball courts include goals at either end and may be surrounded with stands for spectator seating. However, full size basketball courts occupy relatively large amounts of space in many areas which must be enclosed for year-round utilization and are thus relatively expensive. Such drawbacks tend to limit the availability of full size basketball courts and many recreational players have only limited access, if any, to such facilities. Furthermore, indoor full court basketball represents a relatively inefficient use of space as far as indoor sports are concerned since regulations provide for only two teams of five players each on a court at any one time.

Basketball, of course, is not limited to regulation play on full size courts. Basketball goals may be placed over a variety of flat playing surfaces which are put to other uses when basketball is not being played thereon. For example, full size basketball courts may be subdivided into several smaller areas each having a single goal for use by a number of teams simultaneously. The Marsh U.S. Pat. No. 2,831,689 shows a basketball backboard support which is suspended from the ceiling of a structure. The Marsh apparatus is movable between a lowered position for play and a raised position whereat it is out of the way of other activities.

The Drew U.S. Pat. No. 2,881,003 exemplifies another type of convertible basketball goal structure wherein a support frame is pivotally connected to a wall and may be moved between a lowered position extending outwardly from the wall for play and a raised, out-of-the-way position by a winch and cable mechanism. Such devices are fairly standard in the gymnasiums of educational institutions which are designed for multiple uses including partial court and full court basketball games and practice.

Racquetball and handball are other sports which enjoy substantial popularity. Both are played on a court including a hard surface and four walls from which the balls are rebounded and played. Racquetball/handball courts, like basketball courts, may be constructed within enclosures for year-round play. However, in comparison to basketball courts, they occupy relatively small amounts of floor space. Although two players per court is customary, the rules for these games do allow for as many as four players per court.

Due to the popularity of racquetball and handball and the relatively efficient use of space for playing same, large numbers of indoor facilities have been constructed for year-round play. The owners and operators of raquetball/handball court facilities generally endeavor to maximize the usage of their courts by as many players as possible. To this end volleyball nets have been strung across racquetball/handball courts. However, heretofore there has not been available a convertible apparatus specifically designed for mounting a basketball goal on a wall and in particular a wall of a racquetball/handball court in such a manner that it may be raised out of the way for handball and racquetball play and lowered for basketball play with the advantages and features of applicant's invention.

SUMMARY OF THE INVENTION

In the practice of the present invention, a support structure for mounting a basketball goal in a handball-/racquetball court is provided. In two embodiments the support structure is adapted for mounting on a parapet wall and includes a frame assembly with top, clamp, wall and extension subframes. In a third embodiment, the top and clamp subframes are omitted and a mounting mechanism is provided for attaching the support structure to a vertical wall at any desired position thereon. The wall subframe is mounted adjacent to an inner surface of the wall and the extension subframe is pivotally connected thereto. The basketball goal is mounted on the extension subframe and is movable therewith between a lowered play position and a raised storage position.

The principal objects of the present invention are: to provide a basketball apparatus including a support structure for mounting a basketball goal in a racquetball/handball court; to provide such an apparatus with a support structure adapted for mounting on racquetball/handball court walls having different configurations and comprising different materials; to provide such an apparatus wherein the support structure and the goal are movable between a lowered, play position and a raised, storage position; to provide such an apparatus with a frame assembly adapted for receiving a standard, regulation basketball goal; to provide such an apparatus wherein the support structure and the goal are positioned out of the way for handball and racquetball play on the court; to provide such an apparatus with a conveniently accessible hoisting mechanism for moving an extension subframe and the goal between respective play and storage positions; to provide such an apparatus with a support structure constructed primarily of common, readily available steel structural members; to provide such an apparatus which is designed for simultaneous play by one to six players; to provide such an apparatus which is designed to maximize the use of racquetball/handball courts and facilities; to provide such an apparatus for playing a game which combines attributes of basketball, racquetball and handball; to provide such an apparatus for playing a game which combines the shooting and ball handling skills of basketball with the fast-paced action of racquetball; and to provide such an apparatus which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a basketball apparatus embodying the present invention.

FIG. 2 is a cross-sectional view of the apparatus, particularly showing a support structure and a goal in respective lowered, play positions.

FIG. 6 is a cross-sectional view of the apparatus taken generally along lines 6—6 in FIG. 2.

DETAILED DESCRIPTION OF THE INVENTION

Figure 3:
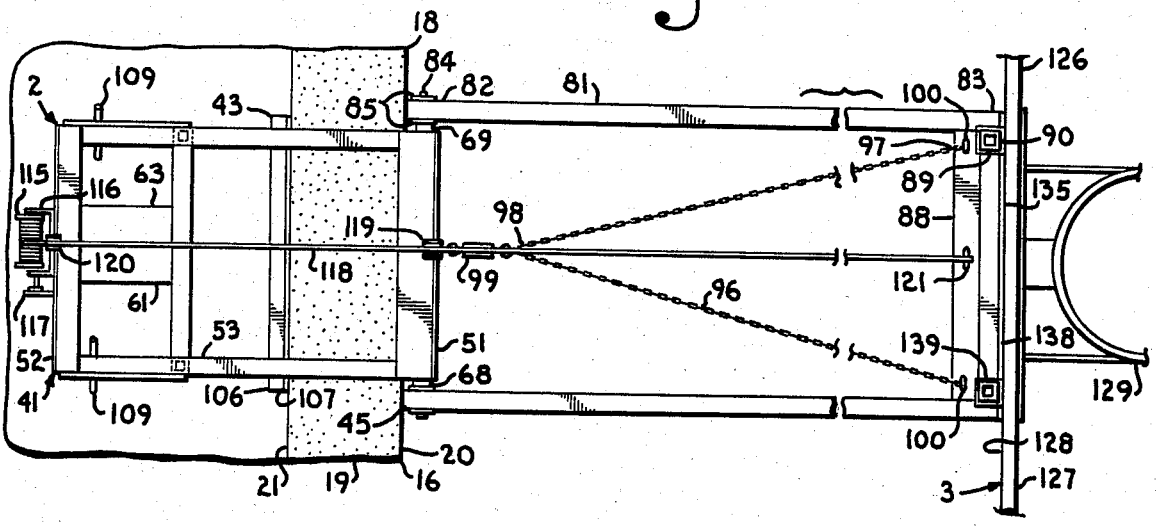
FIG. 3 is a top plan view of the apparatus particularly showing the support structure and the goal in their respective lowered, play positions.

Referring to the drawings in more detail, the reference numeral 1 generally designates a basketball apparatus embodying the present invention and comprising a folding support structure 2 for mounting a basketball goal 3 in a racquetball/handball court 4. For purposes of description herein, "front" refers to the direction to the right and down with respect to the apparatus as shown in FIG. 1 and to the right with respect to the apparatus as shown in FIG. 2. "Back" refers to the direction to the left and up with respect to the apparatus as oriented in FIG. 1 and to the left with respect to the apparatus as oriented in FIG. 2. The terms "inner" and "outer" refer to directions toward and away from the center of the racquetball/handball court 4 respectively.

I. Racquetball/Handball Court

The racquetball/handball court 4 includes a front (back-court) wall 11 and opposite left and right side walls 14, 15. A back (front-court) wall 16 includes a door 17 for player ingress and egress. The back wall 16 includes inner and outer faces 20, 21 and forms a parapet 18 with an upper edge 19. A balcony 12 from which spectators may view the court 4 extends from the back wall outer face 21.

A floor surface 25 is traversed by parallel service and short lines 26, 27 defining a service zone 28 therebetween with left and right service boxes 29, 30 at either end adjacent respective side walls 14, 15. The service zone 28 and service boxes 29, 30 are for handball and racquetball play. In basketball play with the apparatus 1 of the present invention, the lines 26, 27 comprise mid-court and free throw lines respectively and the service zone 28 separates front and back courts 31, 32. Since the player orientations for racquetball or handball play and basketball play with the apparatus 1 are reversed, the front and back courts 31, 32 are adjacent the court back and front walls 16, 11 respectively.

II. Support Structure

The support structure 2 is adapted for mounting the goal 3 on the back wall parapet 18 and is foldable between a lowered play position (FIG. 2) for basketball play and a raised, out-of-the-way storage position (FIG. 4) for racquetball or handball play. A frame assembly 41 generally comprises a top subframe 42, a clamp subframe 43, a wall subframe 44 and an extension subframe 45.

The top subframe 42 includes front and back crosspieces 51, 52 connected to a pair of side members 53 to form the rectangular top subframe 42. The clamp subframe 43 includes a pair of clamp posts 57 attached to and depending downwardly from respective side members 53 and interconnected at their lower ends by a lower crosspiece 58. A pair of diagonal flat-stock braces 60 extend from the posts 57 to respective back ends of the top subframe side members 53. A winch bracket 61 includes a vertical section 62 attached to the top subframe back crosspiece 52 and a horizontal section 63 attached to the clamp subframe lower crosspiece 58; the sections 62, 63 forming a right dihedral angle with respect to each other.

The wall subframe 44 comprises a pair of vertical columns 66, each attached to a respective side member 53 at a miter joint 67 at their upper ends. The vertical columns 66 are interconnected at their lower ends by a bottom crosspiece 68 which terminates at opposite ends 69 extending outwardly from the vertical columns 66. A pair of L-shaped upper spacers 73 include horizontal and vertical legs 74, 75 attached to side members 53 and columns 66 for engagement with the back wall upper edge 19 and inner face 20 respectively. A bottom spacer 76 is attached to the rear face of the bottom cross piece 68 for engagement with the back wall inner face 20. The spacers 73 and 76 may comprise, for example, a resilient material to protect the finish of the back wall 16.

Figure 4:
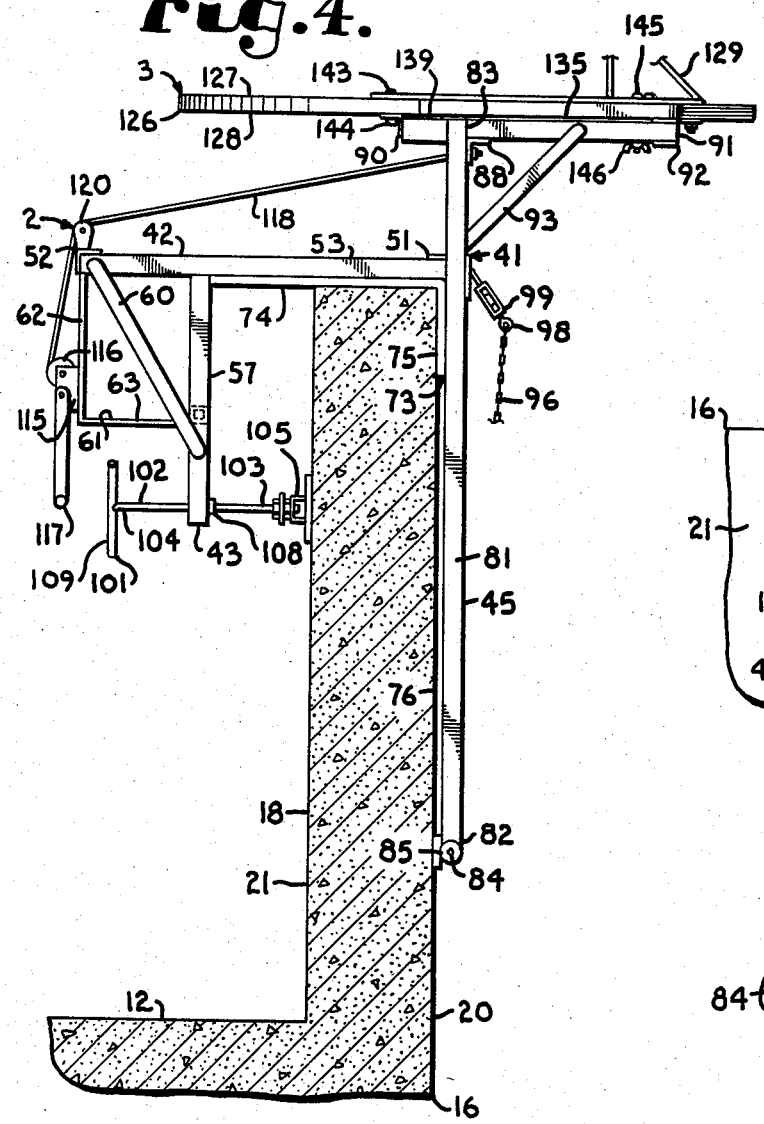
FIG. 4 is a cross-sectional view of the apparatus particularly showing the support structure and the goal in their raised, storage postions.
Figure 5:
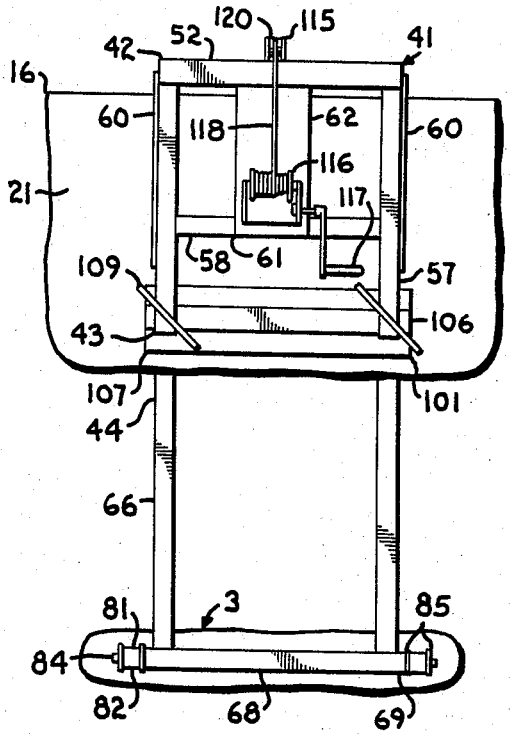
FIG. 5 is a rear elevational view of the apparatus.

The extension subframe 45 includes a pair of arms 81 extending in parallel relation from the wall subframe 44 and having respective proximate and distal ends 82, 83. The arms 81 are pivotally connected at their proximate ends 82 to bottom crosspiece opposite ends 69 by bolts 84 and pairs of washers 85 whereby the extension subframe 45 and the goal 3 mounted thereon are swingable between a lowered, play position as shown in FIG. 2 and a raised, storage position as shown in FIG. 4. The arm distal ends 83 are interconnected by a transverse, extension cross member 88. A pair of extension posts 89 are mounted on the arm distal ends 83 and the extension cross member 88 and include upper and lower ends 90, 91 positioned respectively above and below the extension cross member 88. The extension post lower ends 91 are interconnected by a transverse extension crossbar 92. A pair of diagonal extension braces or gussets 93 interconnect corresponding arms 81 and extension posts 89.

Without limitation on the generality of useful structural shapes, the frame assembly 1 comprises square steel tubing for the side members 53, the clamp subframe posts 57, the clamp crosspiece 58, the vertical columns 66, the wall subframe bottom crosspiece 68, the arms 81 and the extension posts 89. The top subframe front and back crosspieces 51, 52 and the extension cross member 88 comprise steel angle-sections or "angle iron". Steel flat bar stock is used for the braces 60 and 93. The winch bracket 61 is formed from a steel plate.

A flexible tension member 96 comprising a chain is provided for supporting the extension subframe 45 and the goal 3 in their respective play positions and includes opposite ends 97 connected to the extension cross member 88 in proximity to the extension posts 89. At its middle 98, the chain 96 is attached to the center of the front crosspiece 51 by a turnbuckle 99 for leveling the extension arms 81 and for adjusting the extension subframe 45 and goal 3 respective play positions.

A clamp mechanism 101 is mounted on the clamp subframe 42 and comprises a pair of threaded rods 102 with front, unthreaded ends 103 and back ends 104. The threaded rod front ends 103 are journaled in respective connectors 105 attached to opposite ends of a transverse stiffener 106 with a plate 107 attached to its front face for engaging the back wall outer face 21. The threaded rods are threadably received in respective rod nuts 108 attached to the front faces of the clamp posts 57 adjacent their lower ends. The threaded rods 102 extend rearwardly from the rod nuts 108 and through respective unthreaded receivers (not shown) in the clamp post 57 lower ends. A pair of handles 109 are affixed to the threaded rod back ends 104.

A hoisting mechanism 115 comprises a winch 116 mounted on the winch bracket vertical section 62 and having a handle 117. A cable 118 is taken up and let out by the winch 116 and is reeved over front and back pulleys 119, 120 on the top subframe front and back crosspieces 151, 152 respectively. The cable 118 forms a loop through an eyebolt 121 approximately centered on the extension cross member 88 and secured by a cable clamp 122. The winch 116 includes a reduction gear mechanism and a ratchet, both of which are well-known in the art. Alternatively, a motor-driven winch may be provided and may be controlled from a remote location.

The goal 3 comprises a conventional basketball goal including a backboard 126 with front and back faces 127, 128. A hoop 129 is attached to and extends forwardly from the backboard front face 127 with the goal 3 and the extension subframe 45 in the play positions. The hoop 129 is provided with a net 130.

A goal mounting assembly 135 comprises a pair of steel flat stock uprights 136 interconnected by transverse upper and lower crosspieces 137, 138, also of steel flat stock. A pair of square steel tubular sleeves 139 are affixed to the backsides of the uprights 136 in alignment therewith and adjacent the upper crosspiece 137. The sleeves 139 slidably receive the extension post upper ends 90. Upper mounting carriage bolts 143 extend through the backboard 126 and the uprights 136 and receive nuts 144. Lower mounting carriage bolts 145 extend through the backboard 126, the uprights 136 and the extension posts 89 and receive wing nuts 146.

IV. First Modified Embodiment

Figure 7:
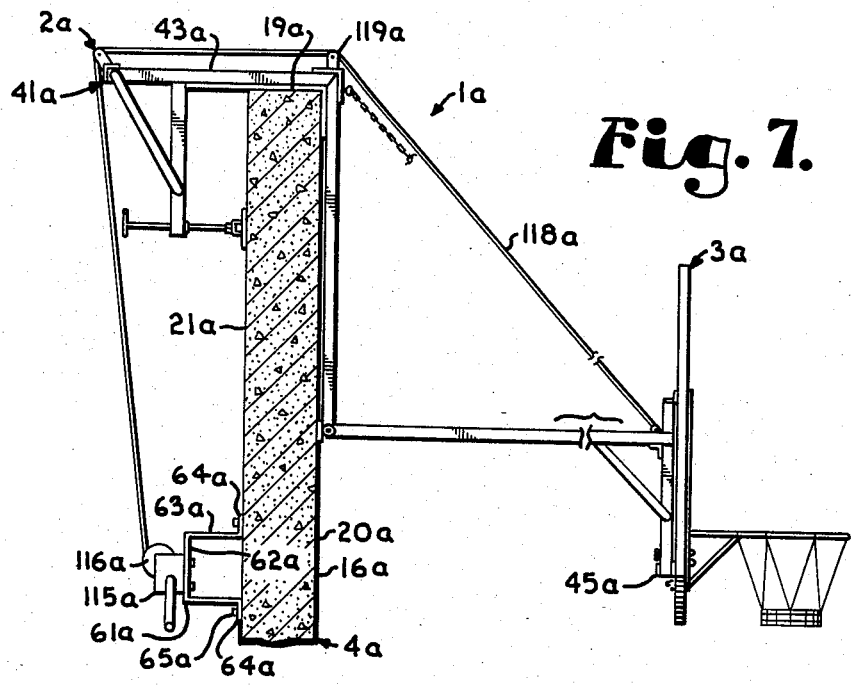
FIG. 7 is a cross-sectional view of a basketball apparatus comprising a first modified embodiment of the present invention.
Figure 8:
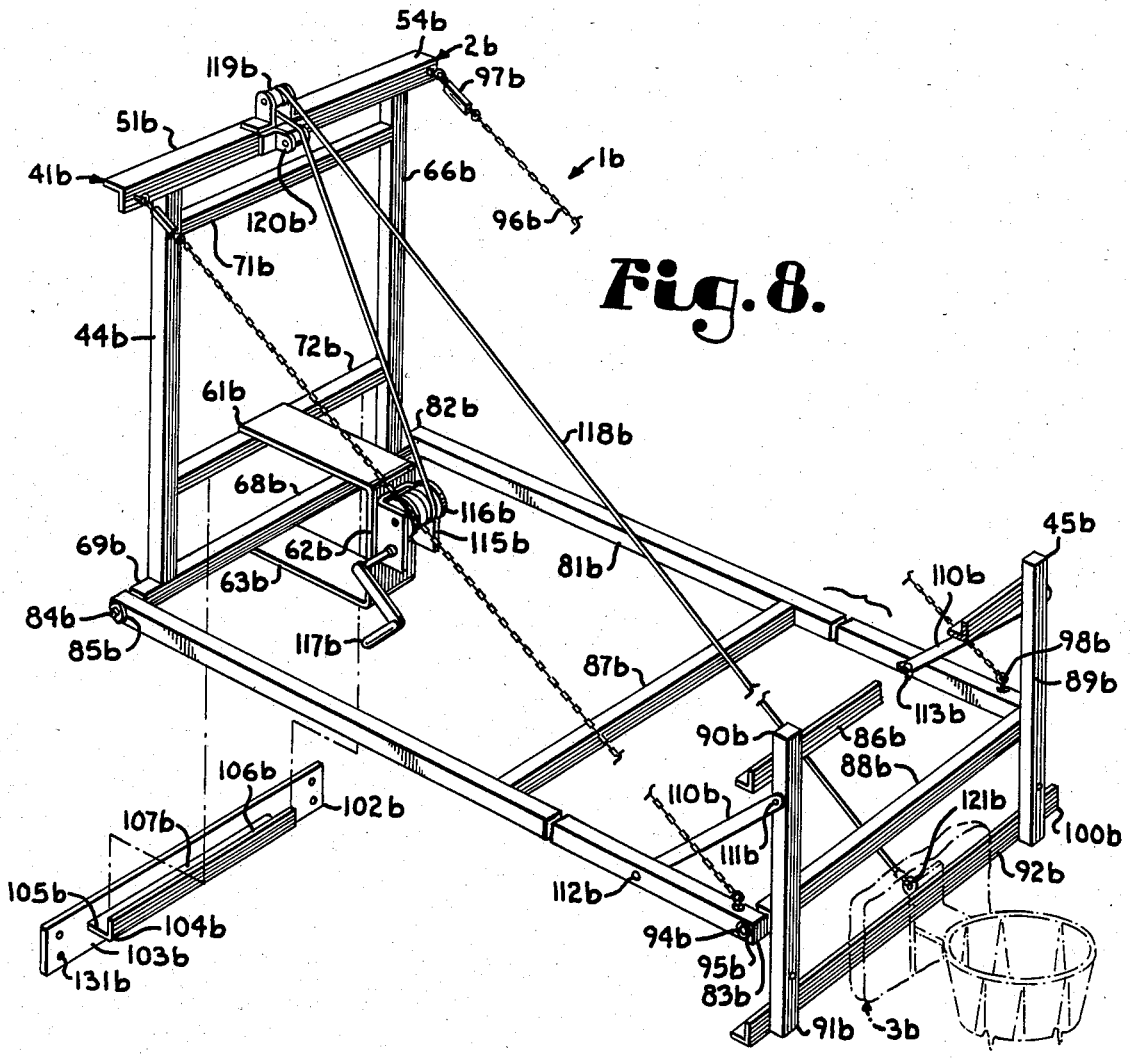
FIG. 8 is a perspective view of a basketball apparatus comprising a second modified embodiment of the present invention.
Figure 11:
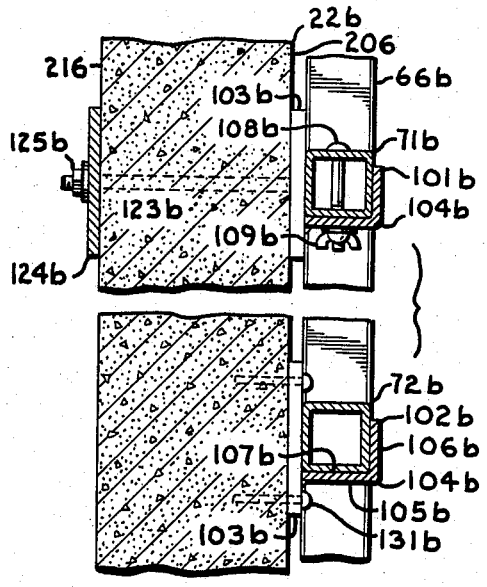
FIG. 11 is an enlarged, fragmentary, cross-sectional view of the second modified embodiment.

A basketball apparatus **1*a* comprising a first modified embodiment of the present invention is shown in FIG. 7 and parts thereof corresponding to similar parts of the basketball apparatus 1** are designated by like reference numerals, except for the addition of the suffix "a" to the reference numerals for the first modified embodiment.

The basketball apparatus **1*a* comprises a support structure 2*a* mounted on a back wall 16*a* of a racquetball/handball court 4*a*. The back wall 16*a* includes an upper edge 19*a* and inner and outer faces 20*a*, 21*a*. The apparatus 1*a* is especially designed for a court 4*a* lacking a balcony or catwalk behind the back wall 16*a*. A winch 116*a* is mounted on the back wall outer face 21*a* whereat it is accessible from a floor surface (not shown). The winch 116*a* is secured to a winch bracket 61*a* having a vertical section 62*a* spaced from the back wall inner face 20*a* and a pair of horizontal sections 63*a* extending forwardly therefrom and terminating at a pair of flanges 64*a* positioned flush against the back wall outer face 21*a*. The winch bracket 61*a* is secured to the back wall 16*a* by mechanical fasteners compatible with the construction of the back wall 16*a*, for example lag bolts 65*a* extending through the flanges 64*a*. The bolts 65*a* may be threadably received in anchors (not shown) imbedded in a masonry block wall 16*a*, or may be threadably received within wood or metal studs if the back wall 16*a*** comprises conventional dry wall construction.

The winch **116*a* comprises part of a hoisting mechanism 115*a* which includes a cable 118*a* trained over front and back pulleys 119*a*, 120*a* attached to a top subframe 43*a* of a frame assembly 41*a* and attached at its end to an extension subframe 45*a* on which a basketball goal 3*a* is mounted. The hoisting mechanism 115*a* functions in a substantially identical manner to the hoisting assembly 115 of the preferred embodiment for raising and lowering the extension 45*a* and the goal 3*a***.

V. Second Modified Embodiment

A basketball apparatus **1*b* comprising a second modified embodiment of the present invention is shown in FIGS. 8–11. Parts of the basketball apparatus 1*b* corresponding to similar parts of the basketball apparatus 1, 1*a* are designated by like reference numerals, except for the addition of the suffix "b" to the reference numerals for the second modified embodiment. The basketball apparatus 1*b* comprises a support structure 2*b* mounted on an inner face 20*b* of a wall 22*b* of a racquetball/handball court 4*b*. Since the support structure 2*b* is mounted directly on the wall inner face 20*b*, the wall 22*b* may comprise either a parapet wall or a floor-to-ceiling wall. Therefore, either the front or back wall of the court 4*b* is suitable for mounting the support structure 2*b***, although the back wall will generally be preferred to minimize interference with handball and racquetball play.

The support structure **2*b* generally comprises a frame assembly 41*b* including a wall subframe 44*b* and an extension subframe 45*b*. The wall subframe 44*b* comprises a pair of vertical columns 66*b* interconnected by transverse, square tubular, upper and lower cross members 71*b*, 72*b*. An angle-section, transverse support member 51*b* is connected to upper ends of the vertical columns 66*b* and terminates in spaced relation outwardly therefrom at respective opposite ends 54*b*. A transverse axle member 68*b* extends between lower ends of the vertical colums 66*b* and terminates at opposite ends 69*b* extending outwardly therefrom. A winch bracket 61*b* includes a vertical section 62*b* and a pair of horizontal sections 63*b* attached to the lower cross member 72*b* and the axle member 68*b*** respectively.

The extension subframe **45*b* includes a pair of parallel arms 81*b* each having a respective proximate and distal end 82*b*, 83*b*. At the axle member opposite ends 69*b*, the arm proximate ends 82*b* are pivotally attached thereto by bolts 84*b* and washers 85*b*. An extension subframe cross member 87b interconnects the arms 81b at approximately their midpoints. An extension axle member 88b is pivotally connected to the arm distal ends 83b by bolts 94b and washers 95b. A pair of extension posts 89b are affixed to the front face of the extension axle member 88b and are interconnected by angle-section, upper and lower extension crossbars 86b, 92b at extension post upper and lower ends 90b, 91b respectively. The extension post upper ends 90 terminate above the level of the extension upper crossbar 86b**.

The extension axle member 88b, posts 89b, upper and lower crossbars 86b, 92b and a pair of extension braces 11Ob collectively comprise an extension goal mounting bracket 100b. The pair of extension braces 110b are pivotally connected to the extension posts 89b by bolts 111b and to the extension arms 81b by bolts 112b at their respective opposite ends. The bolts 112b threadably receive wing nuts 113b which may be removed by an operator for disconnecting the braces 110b from the arms 81b whereby the extension goal mounting bracket 100b may be pivoted about a pivotal axis extending through the extension axle member 88b with respect to the arms 81b.

The extension goal mounting bracket 100b is adapted for receiving a goal mounting assembly 135b similar to the goal mounting assembly 135 described in connection with the preferred embodiment 1 of the present invention.

Upper and lower wall brackets 101b, 102b each comprise an elongated steel plate 103b and an elongated, angle-section hook member 104b with a horizontal leg 105b welded to the plate 103b and a vertical leg 106b. A pair of channels 107b are defined between each plate 103b and a respective hook member 104b for receiving the respective upper and lower cross members 71b, 72b. The upper cross member 71b is secured within its respective channel 107b by a bolt 108b extending through the upper cross member 71b and the hook member horizontal leg 105b and threadably receiving a wing nut 109b.

A plurality of bolts 123b extend through the plate 103b, the wall 22b and an outer plate 124b engaging an outer face 21b of the wall 22b. The bolts 123b threadably receive nuts 125b engaging the outer plate 124b. The lower wall bracket 102b is secured by bolts 131b extending through the respective plate 103b and imbedded in the wall 22b. With the support structure 2b and the goal 3b in their respective play positions, the upper wall bracket 101b is subjected to a rotational force pulling the upper part of the wall subframe 44b away from the wall inner face 20b. Therefore, the additional reinforcing structure of the outer plate 124b connected to the inner plate 103b by bolts 123b extending through the wall 22b is provided, which additional reinforcing structure is not required for the lower wall bracket 102b which primarily supports the wall subframe 44b and is not subjected to the aforementioned pulling force.

Tension members 96b comprising chains are attached to support member ends 54b by respective turnbuckles 97b and at their opposite ends to the lower extension crossbar 92b by eyebolts 98b. The turnbuckles 97b allow for fine adjustment of the support structure 2b and the goal 3b respective play positions.

A hoisting mechanism 115b includes a winch 116b with a handle 117b secured to the winch bracket vertical section 62b for manually raising and lowering the extension subframe 45b and the goal 3b. A flexible member 118b comprising a cable is taken up and played out by the winch 116b and is reeved over a pair of pulleys 119b, 120b mounted on the support member 51b. The cable 118b is connected to the extension cross member 87b by an eyebolt 121b receiving a loop of the cable 118b secured by a cable clamp 122b.

Figure 9:
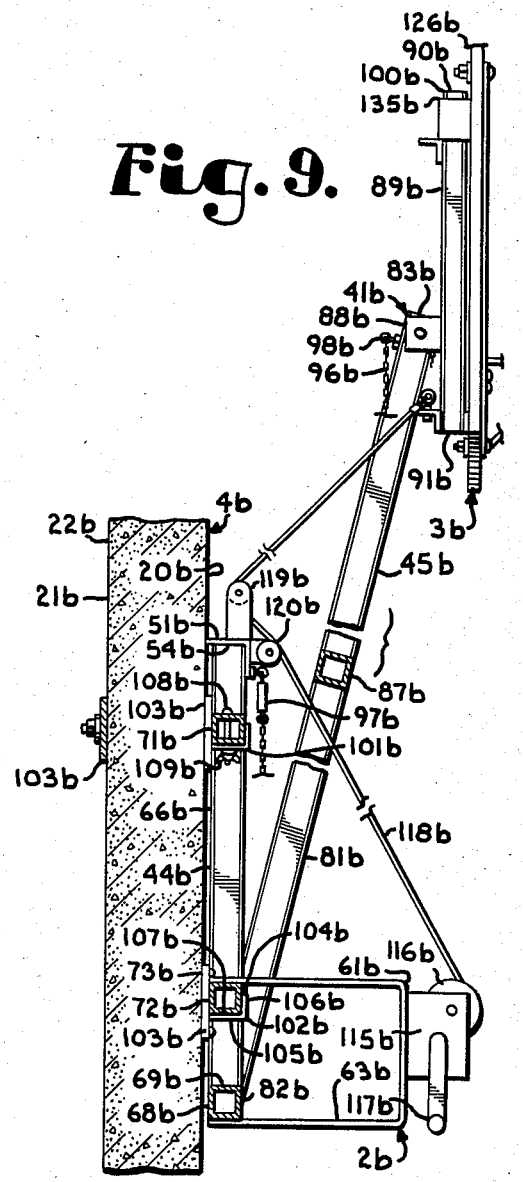
FIG. 9 is a cross-sectional view of the second modified embodiment particularly showing an extension subframe and goal in respective raised, storage positions.
Figure 10:
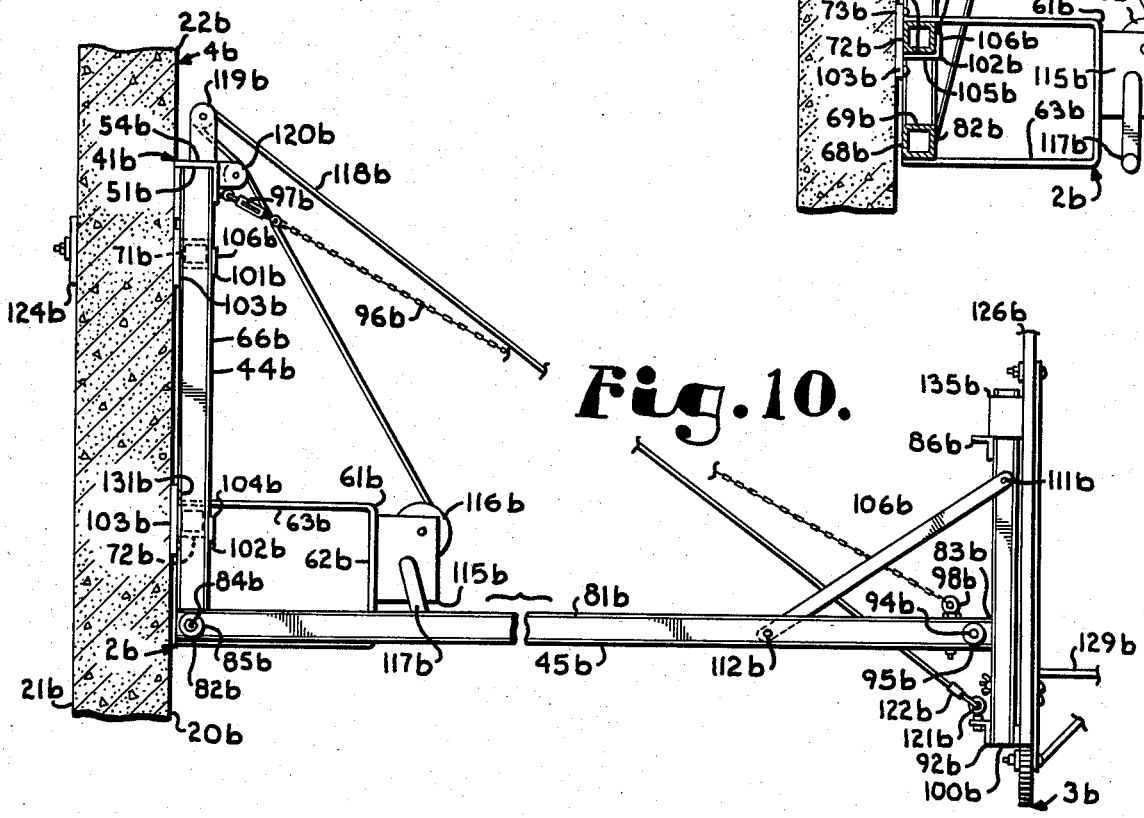
FIG. 10 is a cross-sectional view of the second modified embodiment particularly showing the extension subframe and the goal in their respective lowered, play positions.

In operation, the extension subframe 45b and the goal 3b are movable between play and storage positions as shown in FIGS. 10 and 9 respectively by the hoisting mechanism 115b. To move the goal 3b and the extension subframe 45b to their respective storage positions, the wing nuts 109b are first removed to release the extension braces 110b. The goal 3b is then pivoted about a pivotal axis extending through the extension axle member 88b so that the back board 126b is substantially horizontal and facing downwardly with a hoop 129b pointed down. The winch 116b is then operated by the handle 117b to raise the extension subframe 45b and the goal 3b to the storage position whereat the backboard 126b is substantially parallel to the wall inner face 20b. In the storage position, the support structure 2b and the goal 3b are placed in close proximity to the wall inner face 20b and are thus out of the way to avoid interference with a handball or racquetball game played on the court 4b.

IV. Operation and Game Play

For playing basketball games the extension subframe 45 and the goal 3 are placed in their lowered, play positions as shown in FIG. 2 by releasing the ratchet on the winch 116 and slowly letting out the cable 118 therefrom until the extension subframe 45 and and the goal 3 are supported by the tension members 96. With the extension 45 and the goal 3 in their lowered, play positions, the backboard 126 is spaced a distance of approximately five feet from the back wall inner face 20.

A basketball game devised for the basketball apparatus 1 is disclosed. The maximum number of participants is determined by the size of the court 4, and a maximum of six players has been determined by the applicant to be a practical maximum number of participants for using the basketball apparatus at one time. However, various team combinations such as "one on one", "two on two", "three on three", "two on one", "two on three", and "two on four" may play the basketball game with the present invention.

The side and back (front court) walls 14, 15 and 16 are considered neutral and may be used by the players for passing the ball. In passing, the ball may hit a wall 11, 14, 15 or 16 and then the floor 25 or vice versa, provided the ball is caught before it hits the floor 25 for a second bounce which causes the offensive team to lose possession to the defensive team.

The ball is taken out by bouncing on the front (back-court) wall 11 after any basket is made. When the defensive team obtains possession of the ball, it is bounced off of the front (back-court) wall 11 to convert the defensive team to the offensive team. If any offensive player loses control of the ball and it strikes the front (back-court) wall 11, the defensive team acquires possession. As in conventional basketball play, the offensive team loses possession if one of its players travels or double dribbles with the ball.

A player must be on the offense to score. Baskets made from the front and back courts 31, 32 score two and three points respectively. However, no points are scored when the ball hits a wall 11, 14, 15 or 16 or the support structure 2 before passing through the hoop 129 and the defensive team acquires possession. If a defensive player makes a basket prior to a change of possession by bouncing the ball off of the front (back-court) wall 11, the points therefor are attributed to the offensive team.

Personal fouls committed by the defense entitle the fouled offensive player to a "one for one" free-throw attempt whereby a second free throw may be taken if the first is made. If a free-throw shot is missed, the defense may rebound and convert to offense by bouncing the ball off of the front (back-court) wall 11. During a free-throw attempt, each player standing in the front court 31 must have one hand on a wall 14, 15 or 16 until the fouled player releases the ball. If an offensive player leaves the wall early, the defensive team gets possession at the front (back-court) wall 11. If a defensive player leaves the wall early, the free-throw attempt is repeated if the free-throw was missed. No fouls are incurred for goal tending.

The first player or team to score 25 points is declared the winner, provided there is at least a two point lead. In the event of a tie or a one point lead, "duce overtime" is declared and play resumes until one player or team achieves the necessary two point lead.

It is to be understood that while certain forms of the present invention have been illustrated and described herein, it is not to be limited to the specific forms or arrangement of parts described and shown.

What is claimed and desired to be secured by Letters Patent is as follows:

1. A support structure for movable mounting a basketball goal on a wall with inner and outer faces and an upper edge between predetermined storage and play positions, which comprises:

(a) a wall subframe lying substantially in a vertical plane adjacent said wall outer face and having upper and lower ends with said support structure mounted on said wall;

(b) a top subframe attached to said wall subframe upper end and lying in a substantially horizontal plane over said wall upper edge with said support structure mounted on said wall;

(c) a clamp subframe attached to and depending downwardly from said top subframe on the outside of said wall outer surface with said support structure mounted on said wall;

(d) a clamp mechanism attached to said clamp subframe and engaging said wall outer surface with said support structure mounted on said wall;

(e) an extension subframe including inner and outer ends, said extension subframe being pivotally connected at its inner end to said wall subframe lower end and forming a horizontal pivotal axis therebetween;

(f) goal mounting means rigidly connected to said extension subframe outer end to prevent relative pivotal movement therebetween, and adapted for mounting a basketball goal on said extension subframe;

(g) cable means connected to said extension subframe in spaced relation from its inner end;

(h) winch means connected to said cable means and adapted for taking up and letting out said cable whereby said extension subframe and goal mounting means pivot about said pivotal connection between storage and play positions; and (i) said extension subframe being longer than said wall subframe whereby said goal mounting means is positioned over said top subframe with said support structure in its storage position.

2. The support structure according to claim 1 wherein:

(a) said winch means is mounted on said clamp subframe.

3. The support structure according to claim 1, which includes:

(a) a flexible tension member interconnecting said wall subframe and said extension subframe in spaced relation from the wall subframe lower end and the extension subframe inner end, said tension member being adapted to support said extension subframe and said goal mounting means in said play position.

4. The support structure according to claim 1 wherein:

(a) said wall subframe includes a pair of vertical columns; and (b) said extension subframe includes a pair of arms each having proximate and distal ends, each said arm being pivotally connected at its proximate end to a respective column.

5. The support structure according to claim 1 wherein said clamp mechanism includes:

(a) a clamp nut attached to said clamp subframe;

(b) a threaded rod threadably received in said clamp nut; and (c) a clamp plate attached to said threaded rod and adapted to engage said wall outer face.

6. The support structure according to claim 1 wherein said goal mounting means is connected to said extension subframe in perpendicular relation thereto, said goal mounting means being vertical with said support structure in its play position and horizontal with said support structure in its storage position.

7. The support structure according to claim 1 which includes:

(a) said winch means being mounted on said wall adjacent to said outer face thereof; and (b) pulley means mounted on said top subframe and receiving said cable.

8. The support structure according to claim 1 wherein:

(a) said goal mounting means comprises:

(1) a post mounted on one of said extension subframe and said goal; and (2) a sleeve mounted on the other of said extension subframe and said goal, said sleeve being adapted for slidably receiving said post.

9. A support structure for movably mounting a basketball goal on a wall with inner and outer faces between predetermined storage and play positions, which comprises:

(a) a wall subframe having upper and lower ends;

(b) wall subframe mounting means for mounting said wall subframe on said wall in a vertical plane adjacent thereto;

(c) an extension subframe including inner and outer ends, said extension subframe being pivotally connected at its inner end to said wall subframe lower end, said extension subframe being pivotable with respect to said wall subframe about a horizontal pivotal axis parallel to said wall;

(d) goal mounting means having upper and lower ends and pivotally connected therebetween to said extension subframe outer end, said goal mounting means being adapted for mounting a basketball goal on said extension subframe outer end;

(e) cable means connected to said goal mounting means lower end;

(f) pulley means mounted on said upper end of said wall subframe and receiving said cable means;

(g) a winch mounted on said wall subframe lower end and receiving said cable means, said winch being adapted for taking up and letting out said cable whereby said extension subframe is pivoted with respect to said wall subframe, said goal mounting means is pivoted with respect to said extension subframe and said goal is raised and lowered between its storage and play positions.

10. The support structure according to claim 9 wherein:

(a) said goal mounting means lower end is adapted to engage said extension subframe for pivoting said extension subframe when said cable means is taken up.

11. The support structure according to claim 9, which includes:

(a) a releasable extension brace selectively interconnecting said extension subframe and said goal mounting means to prevent relative rotation therebetween with said support structure in its play position.

12. The support structure according to claim 9 wherein:

(a) said wall subframe mounting means comprises a cross member on one of said wall subframe and said wall and a hook member on the other of said wall subframe and said wall, said hook member being adapted to receive said cross member.

13. The support structure according to claim 12 wherein:

(a) said cross member comprises a transverse, longitudinal member attached to said wall subframe; and (b) said hook member comprises a transverse, elongated angle-section member and a mounting plate affixed thereto for engaging said wall, said angle-section hook member forming a channel with respect to said plate for receiving said cross member.

14. The support structure according to claim 13 which includes:

(a) said wall having inner and outer faces;

(b) said wall mounting plate comprising an inner plate and being attached to said wall on said inner face thereof;

(c) an outer, reinforcing plate; and (d) a mechanical fastener extending through said wall and engaging said plate whereby said inner plate is retained against said inner wall and said outer plate is retained against said outer wall.

15. The support structure according to claim 9 which includes:

(a) pulley means mounted on said wall subframe above said winch, said cable means being reeved over said pulley means.

16. A basketball apparatus, which comprises:

(a) a court including:

(1) a back wall with a parapet, an upper edge, an inner face and an outer face;

(2) a pair of opposite side walls;

(3) a front wall; and (4) a floor;

(b) a support structure including:

(1) a top subframe including front and back crosspieces and a pair of opposite side members;

(2) a clamp subframe including a pair of clamp posts depending downwardly from respective said top subframe side members, a clamp crosspiece interconnecting said clamp posts and a pair of diagonal braces each interconnecting a respective top subframe side member and a respective clamp post;

(3) a wall subframe including a pair of vertical columns each attached to and depending from a respective top subframe side member and a wall subframe bottom crosspiece with opposite ends interconnecting said vertical columns; and (4) an extension subframe including a pair of arms each having proximate and distal ends, said arms being pivotally connected to respective wall subframe crosspiece opposite ends at said proximate ends thereof, an extension cross member interconnecting said arm distal ends, a pair of extension posts with upper and lower ends, an extension crossbar interconnecting said extension post lower ends and a pair of extension braces each interconnecting a respective arm and a respective extension post;

(c) a basketball goal including:

(1) a backboard with front and back faces;

(2) a hoop attached to said backboard front face and extending therefrom; and (3) a goal mounting assembly attached to said backboard back face and including a pair of uprights interconnected by upper and lower crosspieces and a pair of sleeves each attached to a respective upright and adapted for slidably receiving said post upper ends;

(d) a tension member attached to said extension subframe and adapted for supporting said extension subframe with said arms in a horizontal position and said basketball goal in a play position spaced outwardly from said court back wall;

(e) a clamp mechanism including:

(1) a pair of clamp nuts each attached to a respective clamp post;

(2) a pair of threaded rods each threadedably received in a respective clamp nut; and (3) a clamp plate attached to said threaded rods and adapted for engaging said back wall outer face; and (f) a hoisting mechanism including:

(1) a flexible cable attached to one of said extension subframe and said goal; and (2) a winch connected to said flexible cable;

(3) said hoisting mechanism being adapted for raising said extension subframe and said basketball goal from said play positions to storage positions with said arms positioned in proximity to said back wall and said back board positioned horizontally and above said back wall upper edge.

17. The basketball apparatus according to claim 16 which includes:

(a) said winch being mounted on said clamp subframe.

18. The basketball apparatus according to claim 16 which includes:

(a) said winch being mounted on said back wall.

* * * * *